US012173979B2

(12) United States Patent
Lin

(10) Patent No.: US 12,173,979 B2
(45) Date of Patent: Dec. 24, 2024

(54) PROTECTIVE COVER FOR SIGHTING DEVICE

(71) Applicant: Alan Nathan Lin, Arcadia, CA (US)

(72) Inventor: Alan Nathan Lin, Arcadia, CA (US)

( * ) Notice: Subject to any disclaimer, the term of this patent is extended or adjusted under 35 U.S.C. 154(b) by 0 days.

(21) Appl. No.: 18/523,741

(22) Filed: Nov. 29, 2023

(65) Prior Publication Data

US 2024/0280341 A1 Aug. 22, 2024

Related U.S. Application Data

(63) Continuation-in-part of application No. 18/111,816, filed on Feb. 20, 2023.

(51) Int. Cl.
*F41G 1/30* (2006.01)
*F41A 35/02* (2006.01)
*F41G 1/38* (2006.01)

(52) U.S. Cl.
CPC ..... *F41A 35/02* (2013.01); *F41G 1/30* (2013.01); *F41G 1/38* (2013.01)

(58) Field of Classification Search
CPC ..... F41A 35/02; F41G 1/30; F41G 1/38
USPC ..... 42/143
See application file for complete search history.

(56) References Cited

U.S. PATENT DOCUMENTS

| | | | | |
|---|---|---|---|---|
| 8,904,697 | B2 * | 12/2014 | Park | F41G 1/383 42/129 |
| 10,704,862 | B2 | 7/2020 | Chung | |
| 10,921,091 | B2 | 2/2021 | Borrico | |
| 10,948,264 | B1 * | 3/2021 | Brumfield | F41G 1/30 |
| 2012/0102804 | A1 * | 5/2012 | Fesas | F41A 3/66 42/90 |
| 2015/0323278 | A1 * | 11/2015 | Pisani | F41A 35/02 42/96 |
| 2017/0102204 | A1 * | 4/2017 | Mezynski | F41G 1/54 |
| 2017/0142301 | A1 * | 5/2017 | Simmon | F41G 11/00 |
| 2022/0026175 | A1 * | 1/2022 | Chavez | F41G 1/30 |
| 2022/0390206 | A1 * | 12/2022 | Hamilton | F41G 1/345 |
| 2022/0390207 | A1 * | 12/2022 | Chavez | F41G 1/01 |
| 2023/0054268 | A1 * | 2/2023 | Schulte | F41G 1/30 |
| 2023/0142324 | A1 * | 5/2023 | Campbell | H04N 23/56 42/113 |
| 2023/0411763 | A1 * | 12/2023 | Sheets, Jr. | H01M 50/247 |
| 2024/0011739 | A1 * | 1/2024 | Smith | F41G 1/38 |
| 2024/0044605 | A1 * | 2/2024 | Sanders | F41C 23/16 |

* cited by examiner

*Primary Examiner* — Michael D David
(74) *Attorney, Agent, or Firm* — Ying-Ting Chen; Law Office of Michael Chen

(57) ABSTRACT

A protective cover for a sighting device installed on a firearm includes a cover body configured to be couplable to the sighting device and having a rear vision opening; the sighting device having a top protrusion; wherein the cover body includes a top securing unit which is configured to be clipped on the top protrusion to tightly secure the cover body on the sighting device.

17 Claims, 20 Drawing Sheets

PROTECTIVE COVER FOR SIGHTING DEVICE

FIELD OF THE DISCLOSURE

The present disclosure relates to a protective cover, and more particularly to a protective cover for a sighting device, reflex sight or a scope device with a cover body configured to be covered on the sighting device, even during the performance of operational actions such as aiming, shooting and against recoil without removing the protective cover and a lens shield configured to be covered on a reflective lens of the sighting device to block or reduce the interference generated from the UV lights with the light source generated from the sighting device.

BACKGROUND OF THE DISCLOSURE

Generally, miniature reflex sights, also commonly known as mini red-dot sights, are non-magnifying reflector sights that commonly are used with handguns and small armaments, such as rifles and crossbows. Reflex sights are also used for other aiming purposes, for example as a finder scope for use with a telescope. Reflex sights typically include a partially reflecting transparent element, such as a lens or flat glass element, that the user looks through to view a target and an illuminated aiming mark or reticle pattern. In a reflex sight utilizing a reflecting lens element, the aiming mark is typically generated by a small light emitting diode at the focal point of the lens. In reflex sights including a flat glass element, the aiming mark is generated by an illumination source directed toward the flat glass element.

However, the above-mentioned reflex sight may be cumbersome to use during exposure to the daylight/sunlight. While the reflex sight is exposed under the sunlight or high intensity of daylight, the UV lights may interfere with the aiming mark, and in such a situation, the user may have a hassle locating the targets, to cause miss-shooting.

Currently, in order to protect the sighting device, reflex sight or scope, a protective cover may be used to cover on; however, while the current protective cover is covered on the sighting device, the function of aiming cannot be approached. In addition, the current protective cover is easy to fall down and without an appropriate way to securely the protective cover on the sighting device.

There may exist a desire to develop a protective cover that can effectively reduce the interference generated from the daylight/sunlight with the aiming mark.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, the protective cover may comprise a cover body configured to be couplable to a sighting device and have a vision opening; and a lens shield detachably covered on the vision opening.

In another aspect combinable with the general implementation, the cover body may comprise a housing portion dimensioned to conform with the sighting device and a base portion configured to lock on the sighting device.

Among the many possible implementations of the protective cover, the cover body may comprise a housing opening where the sighting device is passed through and a rear vision opening where a light source generated by the sighting device passes through.

Further, it is contemplated that the cover body is configured to form a housing for receiving the sighting device placed therein.

In the alternative, the cover body may comprise at least one locking unit formed on an inner surface of the cover body and configured to be locked on the sighting device.

It is still further contemplated that the cover body may comprise at least one locking unit that protrudes from the inner surface of the cover body and is configured to be inserted into the sighting device.

The contemplated cover body can have at least one adjusting unit formed on side surfaces of the cover body and configured to adjust the effects of a light source generated from the sighting device.

In one embodiment, the cover body may be configured to cover a top sight portion of the sighting device.

In another aspect combinable with the general implementation, the sighting device may comprise at least one concave slot configured to conform with the locking unit formed on the cover body.

In another aspect combinable with the general implementation, the cover body may comprise at least one locking unit to be inserted into at least one concave slot formed on the sighting device to affix the cover body on the sighting device.

In another aspect combinable with the general implementation, the cover body may comprise at least one adjusting unit covered on a portion of the sighting device, wherein the portion of the sighting device may be configured to adjust the effects of the light source generated from the sighting device.

In another aspect combinable with the general implementation, the lens shield may be attached to the inner surface of the cover body to cover the vision opening of the cover body.

In another aspect combinable with the general implementation, the cover body may comprise a rear vision opening aligned with the vision opening, wherein a dimension of the rear vision opening is larger than a dimension of the vision opening.

In another aspect combinable with the general implementation, the cover body may comprise a retaining track being inwardly extended from the inner surface of the cover body and to conform with a dimension of the lens shield.

In another aspect combinable with the general implementation, the lens shield may comprise a lens peripheral edge biased against the retaining track formed along an inner surface of the vision opening to retain the lens shield covering the vision opening.

In another aspect combinable with the general implementation, a light source generated from the sighting device may be passed through the vision opening and reach the lens shield.

In another aspect combinable with the general implementation, the lens shield may comprise materials adapted to block ultraviolet lights.

In another aspect combinable with the general implementation, the protective cover for the sighting device installed on the firearm may comprise a cover body configured to be couplable with the sighting device and having a rear vision opening; the sighting device having a top protrusion; wherein the cover body comprises a top securing unit which is configured to clip on the top protrusion to tightly secure the cover body on the sighting device.

In another aspect combinable with the general implementation, the cover body comprises a vision opening and a lens shield being detachably covered on the vision opening, wherein the lens shield comprises an inclined surface formed adjacent to a periphery of the lens shield.

In another aspect combinable with the general implementation, the cover body comprises a top opening formed on a top side of a housing portion of the cover body.

In another aspect combinable with the general implementation, the sighting device comprises a top sight portion, a bottom sight portion integrally extended from the top sight portion and configured to be installed on the firearm, and a middle sight portion formed between the top sight portion and the bottom sight portion.

In another aspect combinable with the general implementation, the cover body comprises a housing portion dimensioned to conform with the sighting device, a base portion having a right base portion and a left base portion integrally extended from the housing portion, and a middle supporting frame horizontally extended and connected between the left base portion and the right base portion to prevent deformation of the cover body.

In another aspect combinable with the general implementation, the cover body comprises a housing portion, a base portion having a right base portion and a left base portion integrally extended from the housing portion, a middle supporting frame horizontally extended and connected between the left base portion and the right base portion, and a downward concave edge form on the middle supporting frame for facilitating aiming.

In another aspect combinable with the general implementation, the top protrusion is outwardly extended from a top sight portion of the sighting device.

In another aspect combinable with the general implementation, the lens shield comprises a plurality of through holes.

In another aspect combinable with the general implementation, the protective cover may comprise an aiming plate cooperated with a vision opening of the cover body, wherein the aiming plate has an aiming slot.

In another aspect combinable with the general implementation, the top securing unit is inwardly extended from an edge defined by a vision opening of the cover body to form a receiving cavity, wherein the top protrusion of the sighting device is engaged within the receiving cavity.

In another aspect combinable with the general implementation, the cover body comprises a housing portion, a base portion, and a bottom securing unit inwardly extended from the base portion, wherein the bottom securing unit is clipped on a bottom sight portion of the sighting device.

In another aspect combinable with the general implementation, the cover body comprises a housing portion, a base portion outwardly extended to form the housing portion, and a concave edge naturally formed between the housing and base portions.

In another aspect combinable with the general implementation, the cover body comprises a concave edge and the sighting device comprises a middle sight portion, wherein the concave edge is locked on the middle sight portion to keep the cover body on the sighting device.

In another aspect combinable with the general implementation, the cover body comprises a plurality of anti-shock elements arranged on an inner surface of a housing portion of the cover body.

In another aspect combinable with the general implementation, the cover body comprises a removable adhesive arranged on an inner surface of a base portion of the cover body.

In another aspect combinable with the general implementation, the cover body comprises at least one locking unit that protrudes from an inner surface of the cover body and is configured to be inserted into the sighting device.

In another aspect combinable with the general implementation, the cover body comprises a recess surface concavely formed on an inner surface of a base portion of the cover body and at least one locking unit upwardly formed on the recess surface.

In another aspect combinable with the general implementation, the cover body comprises at least one aiming block formed on a base portion of the cover body.

In another aspect combinable with the general implementation, the cover body comprises at least one aiming block formed on a base portion of the cover body, wherein each of the aiming blocks is spacedly arranged to form an aiming slot for aiming.

In another aspect combinable with the general implementation, the cover body comprises a housing portion, and a front portion integrally extended from the housing portion to form a one-piece configuration. While this specification contains many specific implementation details, these should not be construed as limitations on the scope of any inventions or what may be claimed but rather as descriptions of features specific to particular implementations of particular inventions. Certain features that are described in this specification in the context of separate implementations can also be implemented in combination in a single implementation. Conversely, various features described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be too precise scale. In reference to the disclosure herein, for purposes of convenience and clarity only, directional terms such as top, bottom, left, right, up, doxmal, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein and all thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

A "lens peripheral edge" of the lens shield, as used herein, refers to the external boundary of a lens shield of the invention. In addition, a "peripheral edge" of a vision opening, as used herein, refers to the external boundary of the vision opening of the invention.

Figure 1:
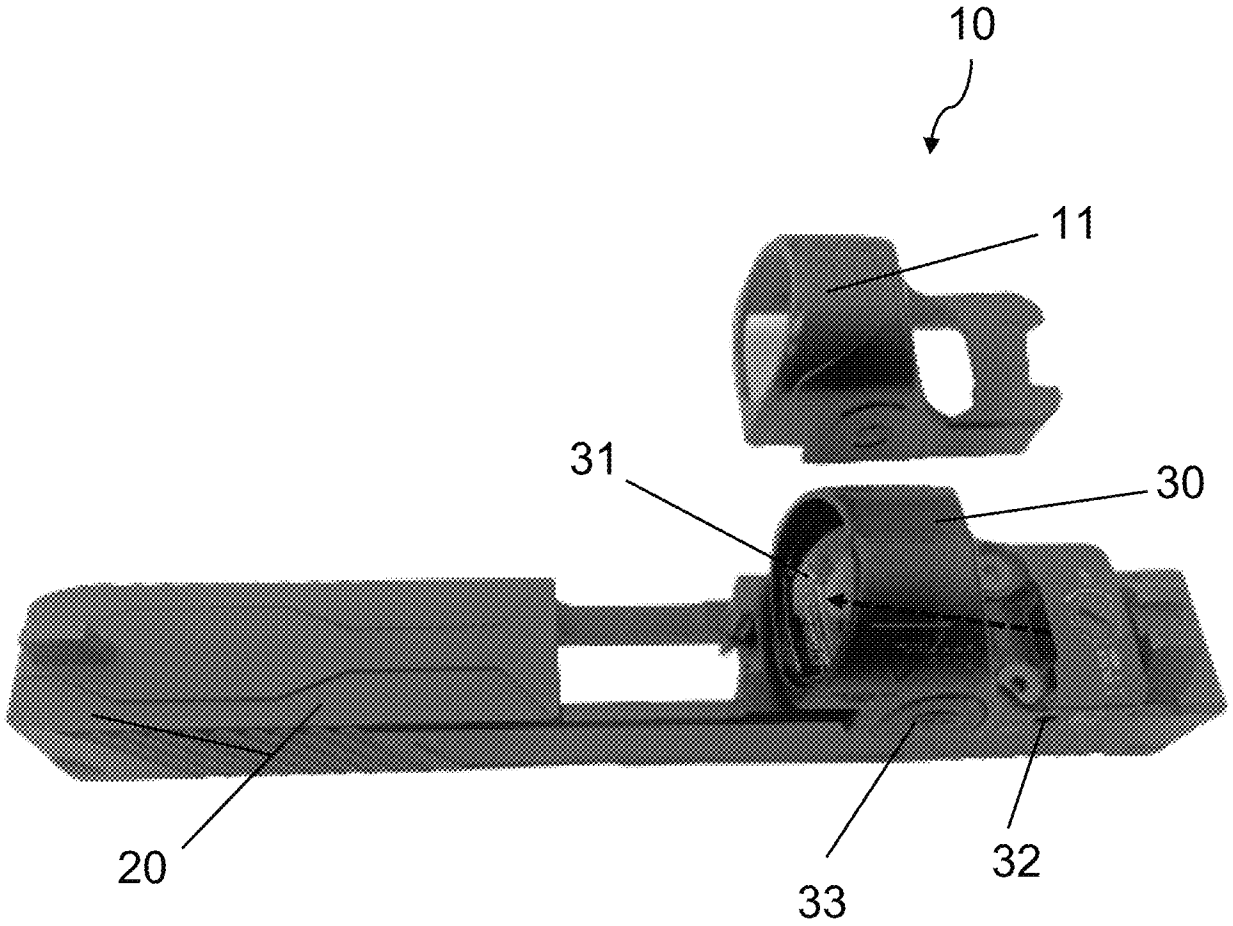
FIG. 1 is a perspective view of a protective cover for a sighting device installed on a firearm according to an aspect of the embodiment.

FIG. 1 generally depicts a perspective view of a protective cover 10 for a sighting device 30 installed on a firearm 20 according to an aspect of the embodiment.

Referring to FIG. 1, the protective cover 10 may comprise a cover body 11 configured to be couplable to a sighting device 30, wherein the sighting device 30 may be detachably mounted on the firearm 20. In one embodiment, the sighting device 30 may generate a light source that may be transmitted to a reflective lens 31 of the sighting device 30. It should be noted that, in some embodiments, the sighting device 30 may be any compatible sight, scope, or optics. It should be understood that the sighting device 30 are exemplary and any other sighting device 30 can be adopted in various embodiments of this disclosure.

Figure 2B:
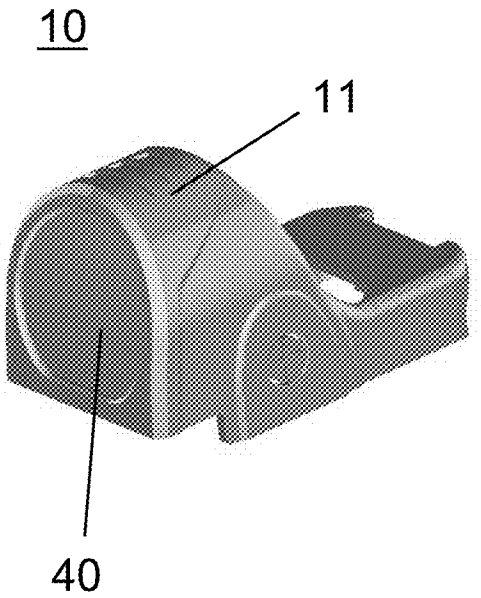
FIGS. 2A-2B are perspective views of a cover body and a lens shield of the protective cover according to an aspect of the embodiment.
Figure 2A:
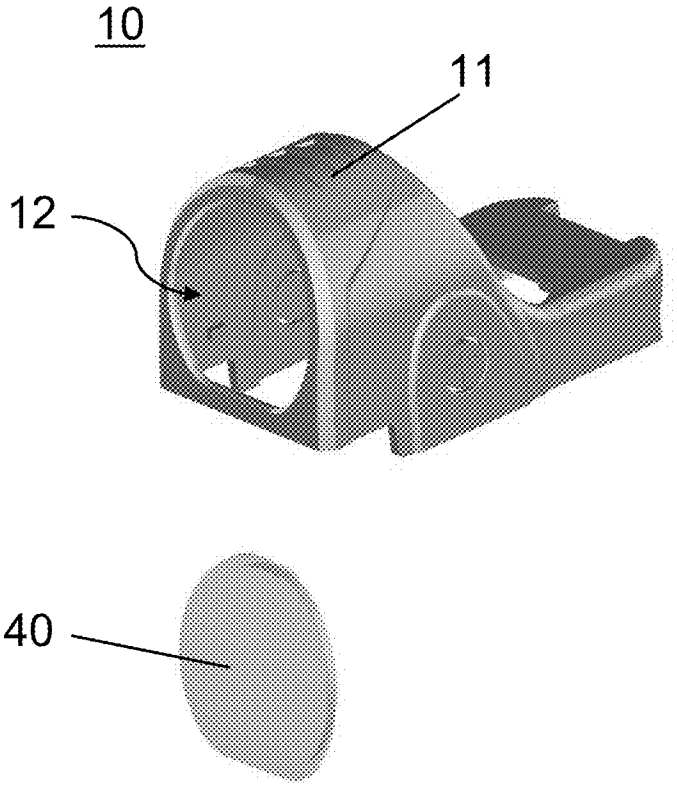

FIGS. 2A-2B generally depict perspective views of the cover body 11 with a lens shield 40 according to an aspect of the embodiment.

Referring to FIGS. 2A-2B, the cover body 11 may comprise a vision opening 12 formed on a front side of the cover body 11. In one embodiment, the cover body 10 may further comprise a lens shield 40 detachably covered on the vision opening 12. For example, the vision opening 12 may be fully covered by the lens shield 40, wherein even if the vision opening 12 is fully covered by the lens shield 40, the shooter is still able to view a red dot for aiming.

Figure 3B:
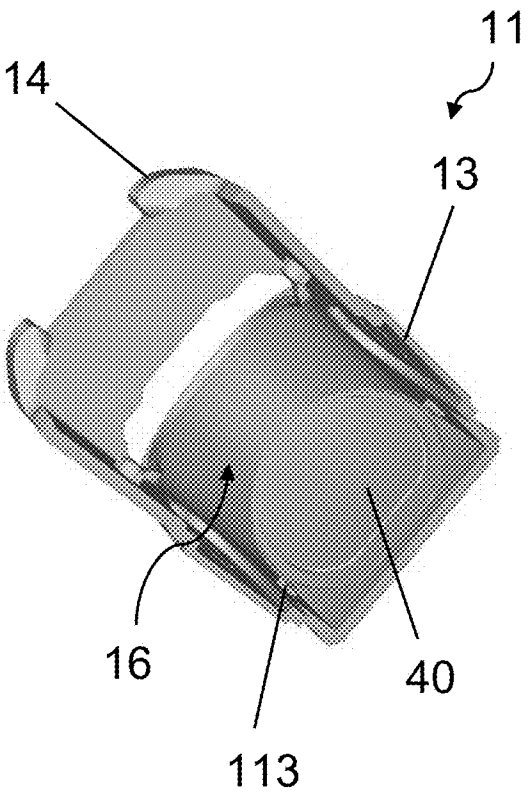
FIGS. 3A-3B are bottom views of the cover body and a lens shield of the protective cover according to an aspect of the embodiment.
Figure 3A:
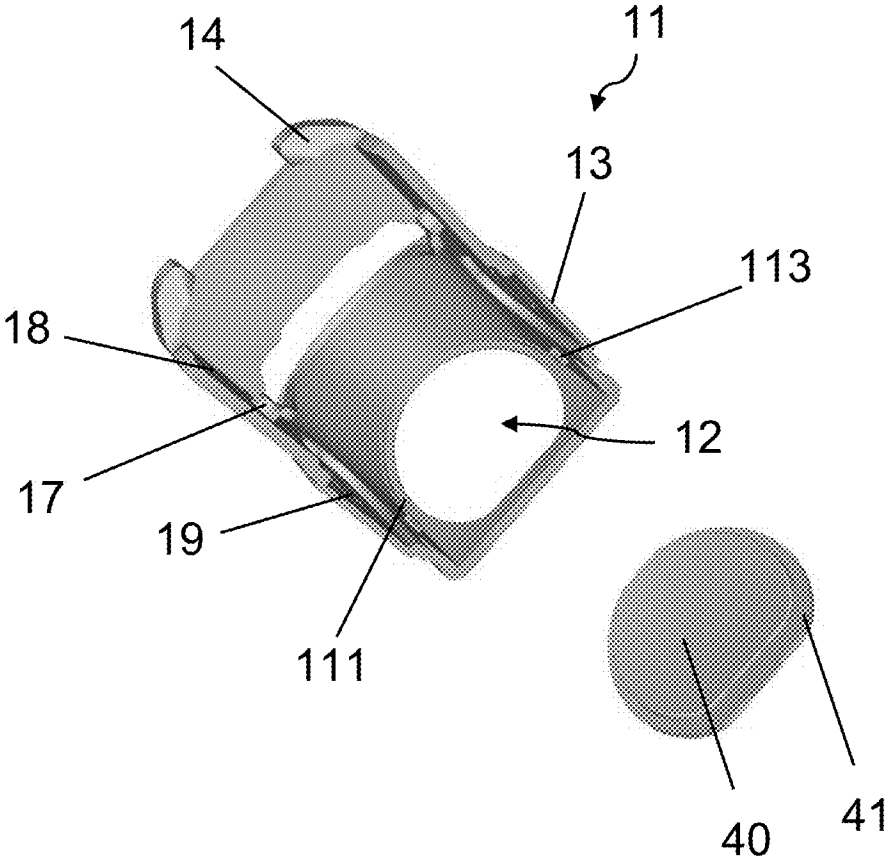

FIGS. 3A-3B generally depict views of the protective cover according to an aspect of the embodiment.

In one embodiment, the cover body 11 may further comprise a housing portion 13 dimensioned to conform with the sighting device and a base portion 14 integrally extended from the housing portion 13, wherein the base portion 14 may be configured to not only securely lock on the sighting device, but also easy to be removed from the sighting device.

Referring to FIG. 3A, the cover body 11 may be dimensioned and configured to form a housing to receive the sighting device.

As shown in further detail in FIGS. 3A-3B, the cover body 11 may comprise at least one locking unit 17 formed on an inner surface 18 of the cover body 11 and configured to lock and/or secure on the cover body 11 on the sighting device.

Referring now to the detail of FIG. 3A-3B, in some embodiments, the cover body 11 may comprise at least one locking unit 17 that protrudes from the inner surface 18 of the cover body 11 and is configured to be inserted into the sighting device. In still some embodiments, the cover body 11 may comprise locking units 17 that protrude from side surfaces of the inner surface 18 of the cover body 11.

It should be noted that in some embodiments, as shown in FIG. 3A, the cover body 11 may comprise at least one adjusting unit 19 formed on side surfaces of the cover body 11 and configured to adjust effects of the light source generated from the sighting device.

With specific reference to FIGS. 1 and. 3A-3B, the sighting device 30 may comprise at least one concave slot 32 formed at locations corresponding to locations of the locking unit 17 formed on the cover body 11, wherein the concave slot 32 may be dimensioned and configured to conform with the locking unit 17.

In some embodiments, the cover body 11 may comprise at least one adjusting unit 19 formed on side surfaces of the cover body 11, wherein the adjusting unit 19 may be configured to be covered on a portion 33 of the sighting device (as shown in FIG. 1). It should be noted that in some embodiments, the portion 33 of the sighting device 30 may be designed to adjust effects of light source generated from the sighting device 30. For example, the effects may be color, brightness, or patterns of the light source.

It should be understood that the above-described effects of the light source are exemplary and any other effects of the light source can be adopted in various embodiments of this disclosure.

Turning now to FIGS. 3A and 3B, the cover body 11 comprises a retaining track 111 being inwardly extended from the inner surface 18 of the cover body 11, wherein the retaining track 111 may form along a peripheral edge of the vision opening 12. In one embodiment, the lens shield 40 may comprise a lens peripheral edge 41 formed along a periphery of the lens shield 40. In still one embodiment, the lens peripheral edge 41 of the lens shield 40 may be biased against the retaining track 111 to retain the lens shield 40 covering on the vision opening 12. In other words, in some embodiments, the lens shield 40 may be attached on the inner surface 18 of the cover body 11 to cover the vision opening 12 of the cover body 11.

Continuing to FIGS. 3A to 3B, the cover body 11 may comprise at least one retaining unit 113 that protrudes from the inner surface 18 of the cover body 11 and is configured to be locked on the sighting device 30 (as shown in FIG. 1). In still some embodiments, the cover body 11 may comprise the retaining units 113 that protrude from the side surfaces of the inner surface 18 of the cover body 11. In such a manner, while the cover body 11 is attached to the sighting device, the retaining unit 113 may be biased against the sighting device to provide more fraction forces between the cover body 11 and the sighting device 30 (as shown in FIG. 1). Therefore, the retaining unit 113 may be configured to facilitate the cover body 11 being retained on the sighting device.

Figure 4A:
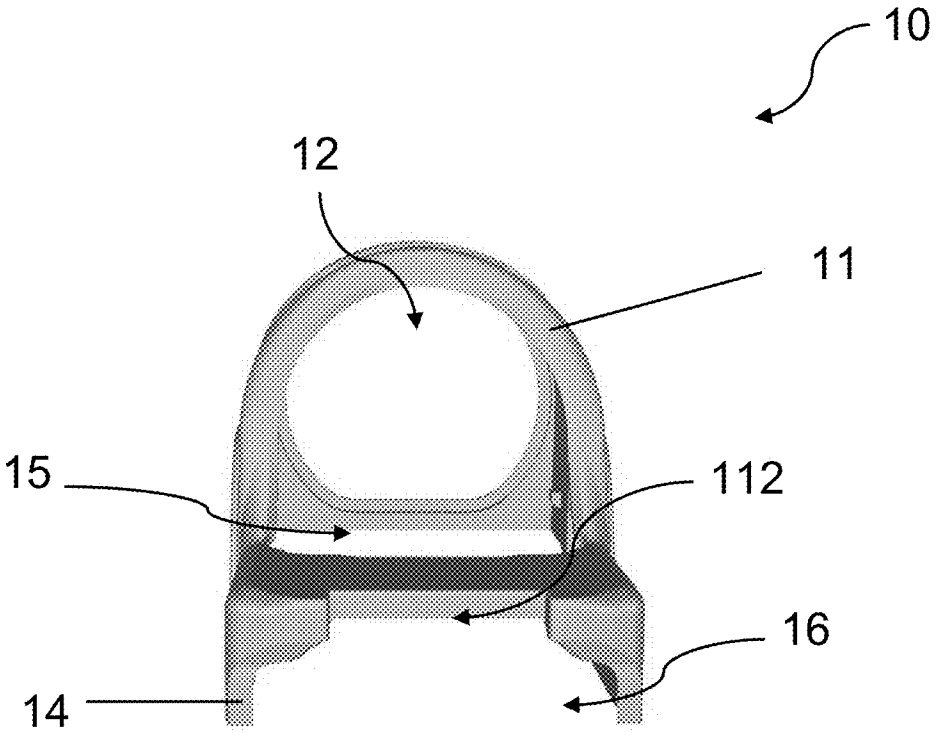
FIG. 4A is a rear view of the cover body of the protective cover according to an aspect of the embodiment.
Figure 4B:
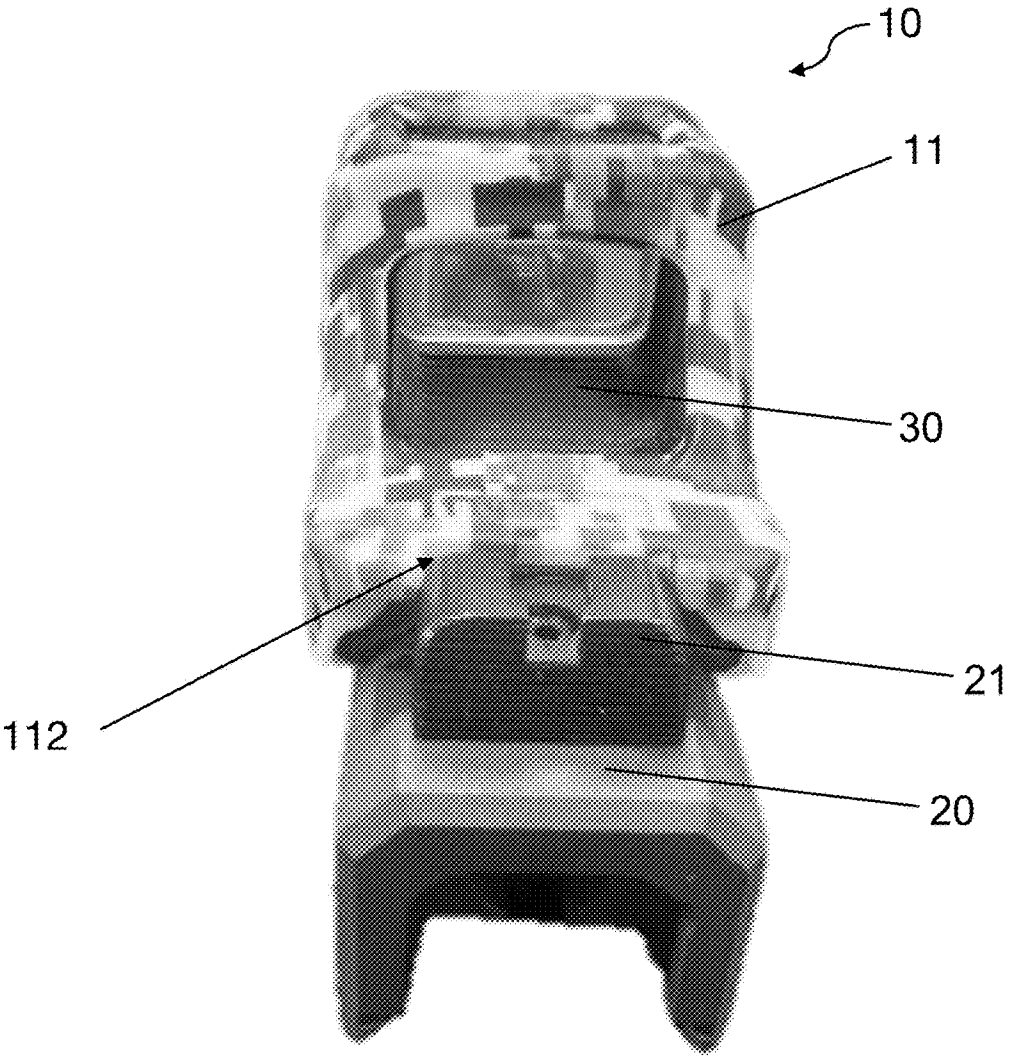
FIG. 4B is a rear view showing that the protective cover is covered on the sighting device installed on the firearm with rear side accessories according to an aspect of the embodiments.

FIG. 4A generally depicts a rear view of the cover body 11 of the protective cover 10 according to an aspect of the embodiment. FIG. 4B generally depicts a rear view of the protective cover 10 covered on the sighting device 30 according to an aspect of the embodiments.

Referring to FIG. 4A, the cover body 11 may comprise a rear vision opening 15 aligned with the vision opening 12. In one embodiment, a dimension of the rear vision opening 15 may be larger than a dimension of the vision opening 12. In still one embodiment, the dimension of the rear vision opening 15 may be smaller than the dimension of the vision opening 12. It should be noted that the dimension of the rear vision opening 15 and the dimension of the vision opening 12 may be predesigned to satisfy the needs of the shooting purpose or the styles of the sighting device.

Continuing to FIG. 4A, the cover body 11 may further comprise the rear vision opening 15 formed on a rear side of the cover body 11, wherein the front side of the cover body 11 may be opposite of the rear side of the cover body 11. In one embodiment, the cover body 11 comprises a housing opening 16 where the sighting device may be passed therethrough and the sighting device (as shown in FIG. 1) may be received inside the cover body 11.

Referring now to the details of FIG. 4A, the cover body 11 may further comprise a notch opening 112 formed on a rear portion of the cover body 11, wherein the vision opening 12 may be formed on a front portion of the cover body 11. The rear portion of the cover body 11 may be opposite of the front portion of the cover body 11. It should be noted that, the notch opening 112 may be designed to fit in with any compatible firearm rear side accessories.

In still some embodiments, the base portion 14 of the cover body 11 may be utilized to facilitate the cover body 11 being detached from the sighting device 30.

As shown in further details of FIG. 4B, while the protective cover 11 is covered on the sighting device 30 installed on the firearm 20, the notch opening 112 may be utilized to match the firearm rear side accessories 21.

Figure 5:
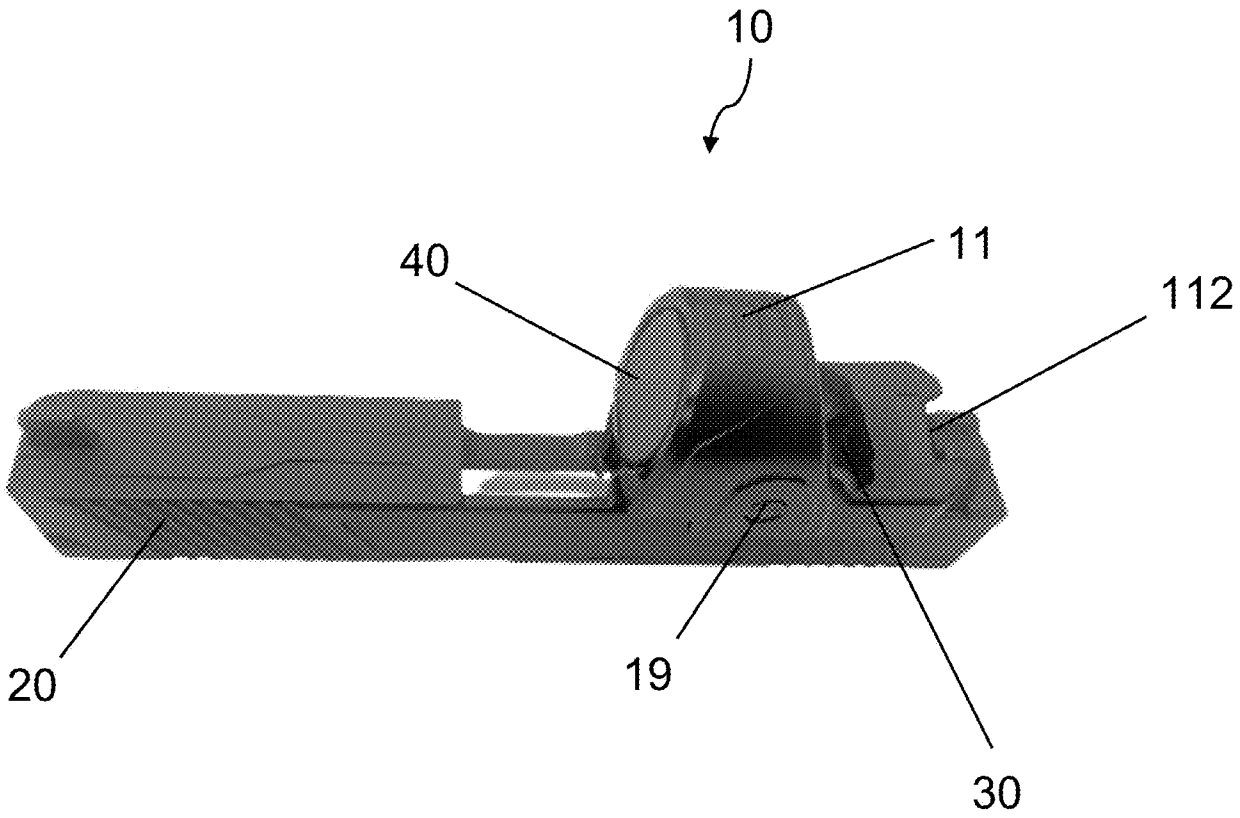
FIG. 5 is a perspective view of the protective cover showing the cover body and the lens shield covered on the sighting device according to an aspect of the embodiment.
Figure 6:
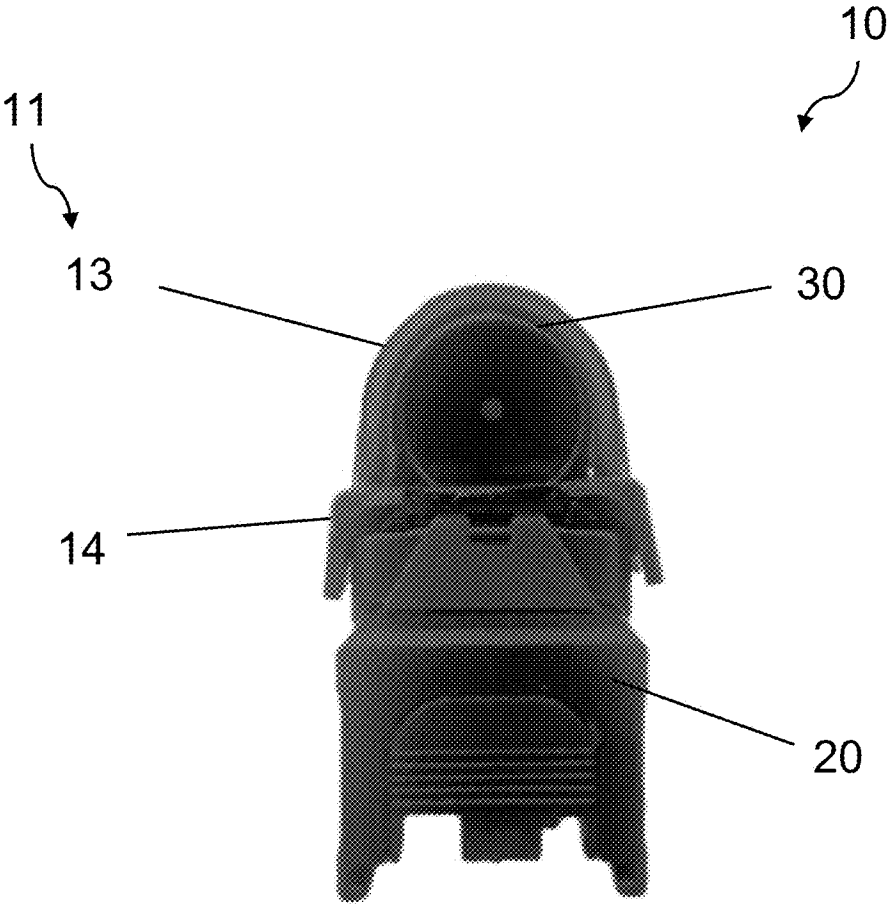
FIG. 6 is a rear view of the protective cover showing the cover body and the lens shield covered on the sighting device according to an aspect of the embodiment.

FIGS. 5-6 generally depict views of the protective cover 10 mounted on the firearm 20 according to an aspect of the embodiment.

Referring to FIGS. 5-6, in one embodiment, the housing portion 13 of the cover body 11 may be configured to cover on a top sight portion of the sighting device 30 and the base portion 14 of the cover body 11 may be covered on a bottom portion of the sighting device 30. And, in such a way, in still one embodiment, the locking unit 17 (as shown in FIGS. 3A and 3B) of the cover body 11 may be inserted into the at least one concave slot 32 (as shown in FIG. 1) formed on the sighting device 30 to affix the cover body 11 on the sighting device 30.

In one embodiment, the dimension of the cover body 11 may be dimensioned to conform with the dimension of the sighting device 30 to allow the sighting device 30 to be received inside the cover body 11. As shown in further details in FIG. 5, the lens shield 40 may comprise materials adapted to block ultraviolet lights, and in such a way, while the light source generated from the sighting device 30 is transmitted to the reflective lens 31 (as shown in FIG. 1), the light source may interfere with UV lights while the shooter fires the firearm 20. Therefore, the lens shield 40 may reduce or block the UV light interference to facilitate the shooter during firing.

It should be understood that the above-described UV lights are exemplary and any other daylights or light source can be adopted in various embodiments of this disclosure.

According to the above-mentioned embodiments, the light source generated from the sighting device 30 may be passed through the vision opening 12 (as shown in FIG. 4A), the rear vision opening 15 (as shown in FIG. 4A), and/or the reflective lens 31 (as shown in FIG. 1) and/or may further reach the lens shield 40.

Figure 7A:
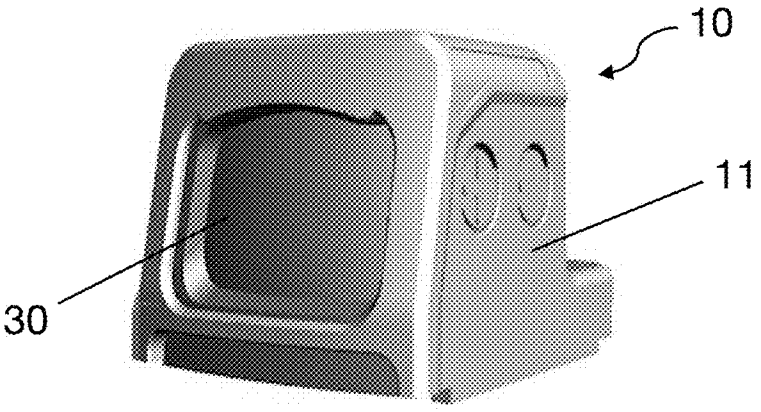
FIGS. 7A and 7B generally depict cross-sectional views of a protective cover covered on the sighting device according to another aspect of the embodiment.
Figure 7B:
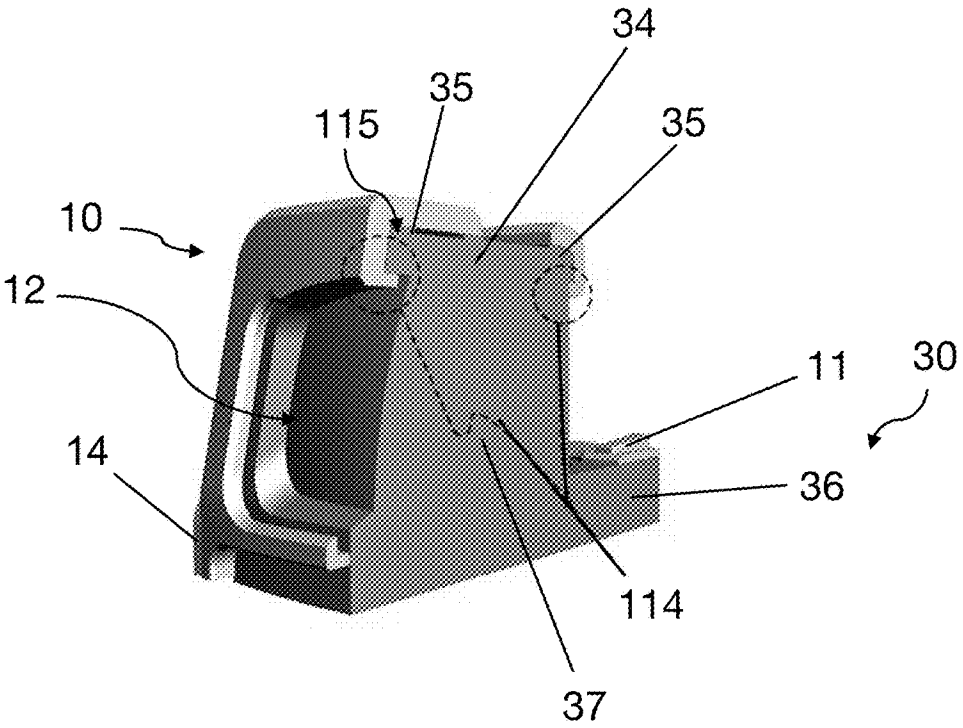

Referring to FIG. 7A and FIG. 7B, the protective cover 10 may comprise the cover body 11 configured to be couplable to the sighting device 30, wherein the sighting device 30 may comprise a top sight portion 34 and a bottom sight portion 36 integrally extended from the top sight portion 34, wherein the bottom sight portion 36 may be configured to be installed on the firearm. In some embodiments, the cover body 11 may further comprise at least one top protrusion 35 outwardly extended from the top sight portion 34 of the sighting device 30.

In some embodiments, the sighting device 30 may comprise the top sight portion 34, the bottom sight portion 36 integrally extended from the top sight portion 34 and configured to be installed on the firearm, and a middle sight portion 37 integrally formed between the top sight portion 34 and the bottom sight portion 36.

In still some embodiments, the cover body 11 may comprise a top securing unit 114 inwardly extended from an edge defined by the vision opening 12, wherein the top securing unit 114 may be inwardly extended from the edge defined by the vision opening 12 to form a receiving cavity 115, wherein the top protrusion 35 of the sighting device 30 may be engaged within the receiving cavity 115. In still some embodiments, while the cover body 11 is covered on the sighting device 30, the top securing unit 114 may be clipped on the sighting device 30, to tightly secure the cover body 11 on the sighting device 30.

Figure 8:
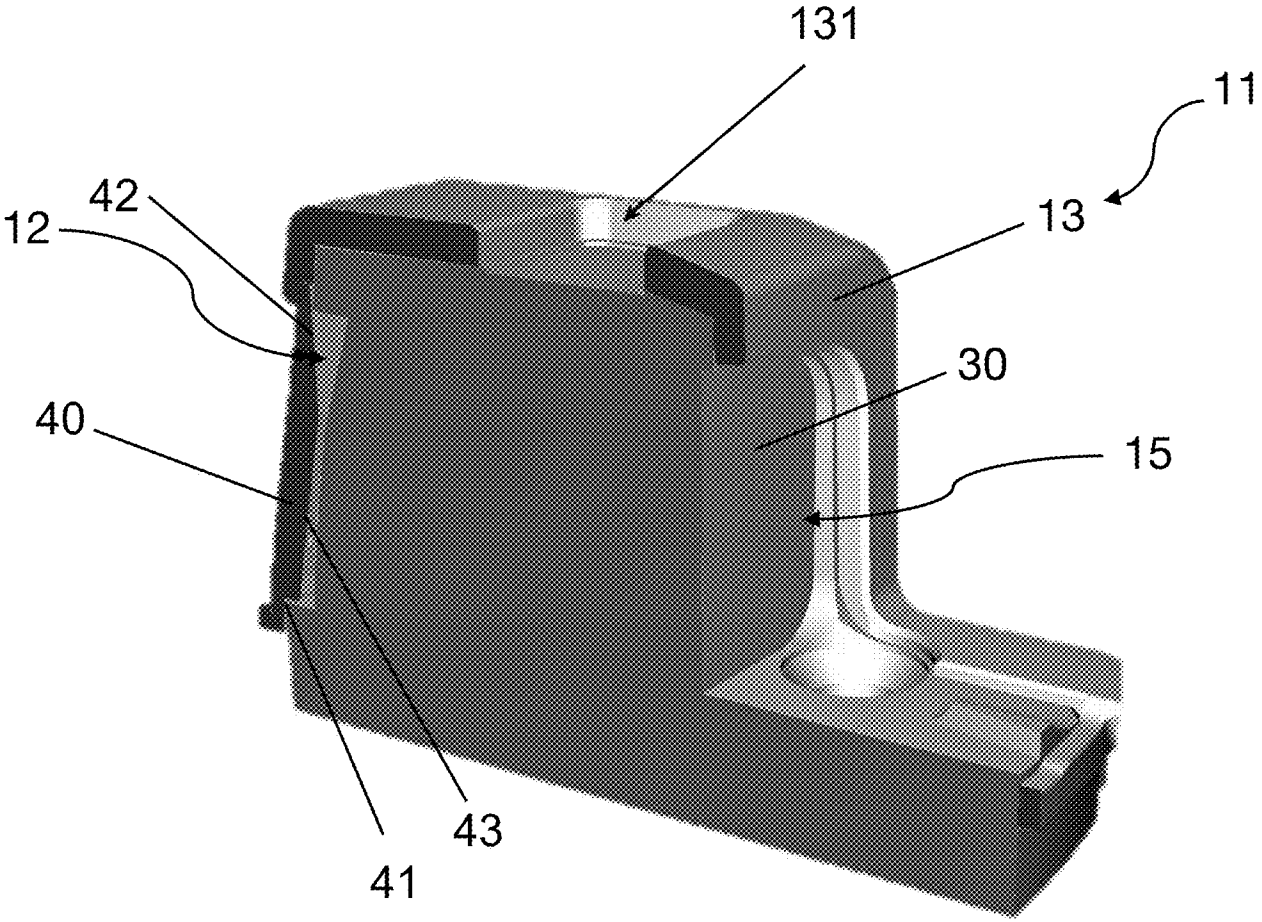
FIG. 8 is a cross-sectional view of a lens shield and the cover body according to an aspect of the embodiments.

Referring to FIG. 8, the cover body 11 comprises the vision opening 12 and the lens shield 40 being detachably covered on the vision opening 12, wherein the lens shield 40 may comprise an inclined surface 42 formed adjacent to a periphery of the lens shield 40. It should be noted that the lens shield 40 may be securely covered on the vision opening 12 by the lens peripheral edge 41, wherein the lens peripheral edge 41 may be a concave edge, and in such a way, the lens shield 40 may comprise a central protruded portion 43 downwardly extended to the periphery of the lens shield 40 to form the lens peripheral edge 41 and the inclined surface 42. In still another embodiment, the inclined surface 42 may facilitate the user to detach the lens shield 40 from the vision opening 12, and in such a way, the user may smoothly slide the lens shield 40 along the inclined surface 42.

Continuing to FIG. 8, the cover body may comprise a top opening 131 formed on a top side of a housing portion 13 of the cover body 11, and in such a way, the top opening 131 may be compatible for the sighting device 30 with solar panels.

Figure 9:
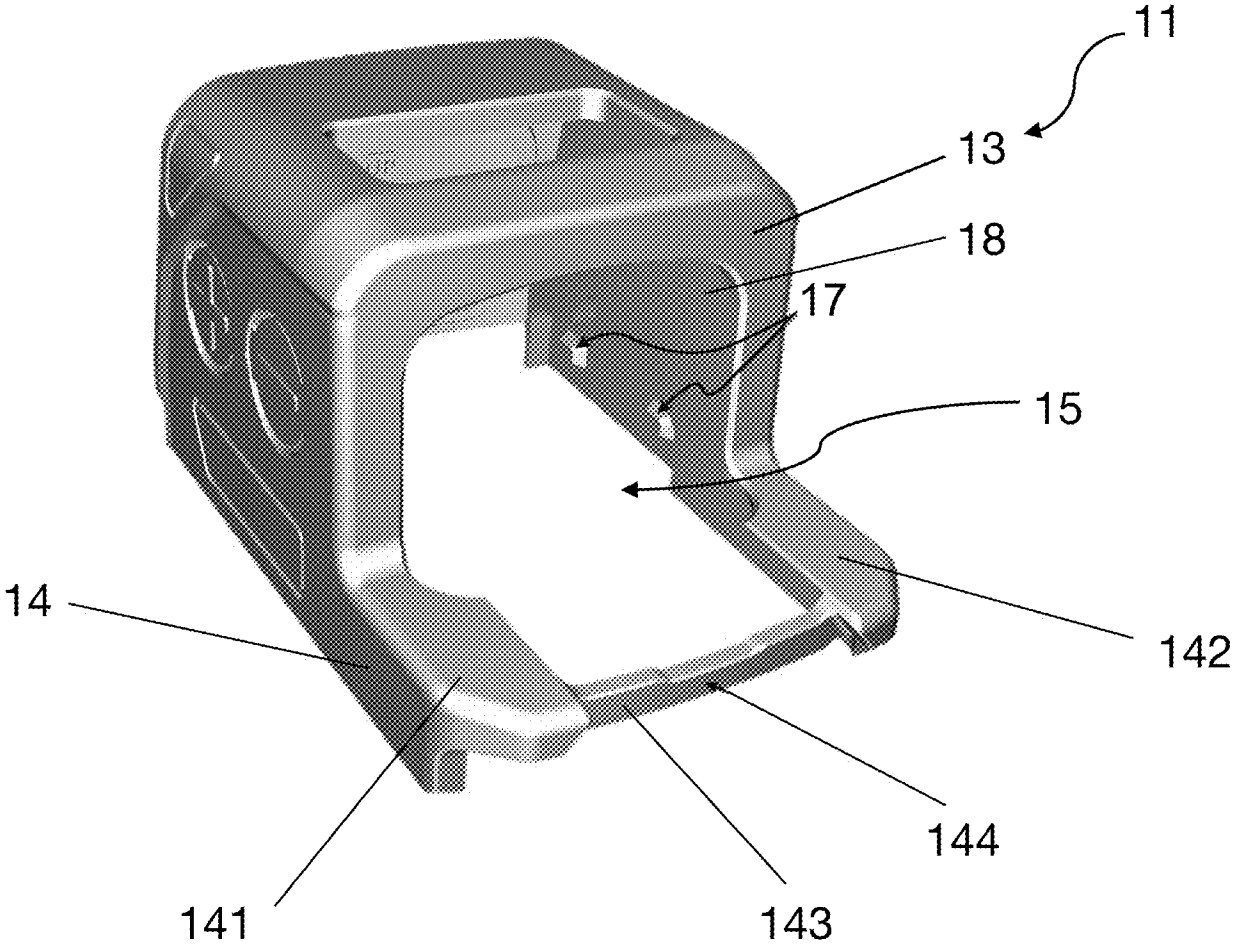
FIG. 9 is a perspective view of the cover body according to an aspect of the embodiments.

Referring to FIG. 9, the cover body 11 may comprise the rear vision opening 15 and at least one locking unit 17 (also shown in FIG. 3A to FIG. 3B) formed on an inner surface 18 of the cover body 11 and configured to lock and/or secure the cover body 11 on the sighting device.

Figure 10:
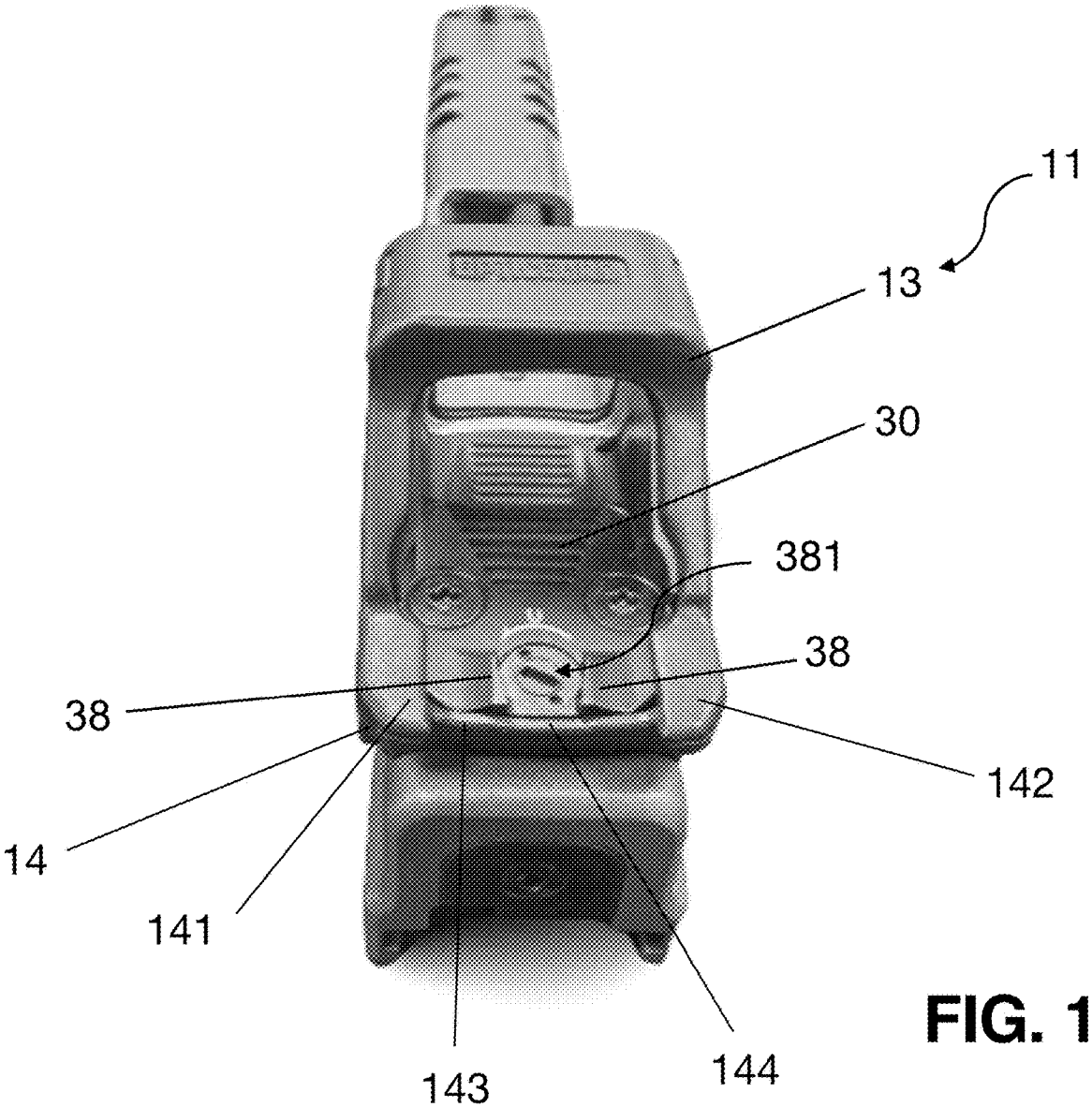
FIG. 10 is a perspective view showing that the perspective cover is secured on the sighting device according to an aspect of the embodiments.

Referring to FIG. 9 and FIG. 10, the cover body 11 may comprise the housing portion 13 dimensioned to conform with the sighting device 30, the base portion 14 having a right base portion 142 and a left base portion 141 integrally and rearwardly extended from the housing portion 13, and a middle supporting frame 143 horizontally extended and connected between the left base portion 141 and the right base portion 142 to prevent deformation of the cover body 11. In still some embodiments, the base portion 14 may further comprise a downward concave edge 144 formed on the middle supporting frame 143 for facilitating aiming. In some embodiments, the downward concave edge 144 may be indentedly formed on the middle supporting frame 143.

As shown in FIG. 10, in some embodiments, the sighting device 30 may comprise at least one rear aiming block 38, wherein each of the rear aiming blocks 38 may be spacedly arranged to form a rear aiming passway 381, and in such a manner, while the cover body 11 is covered on the sighting device 30, the downward concave edge 144 may allow the user for aiming through the rear aiming passway 381.

Figure 11:
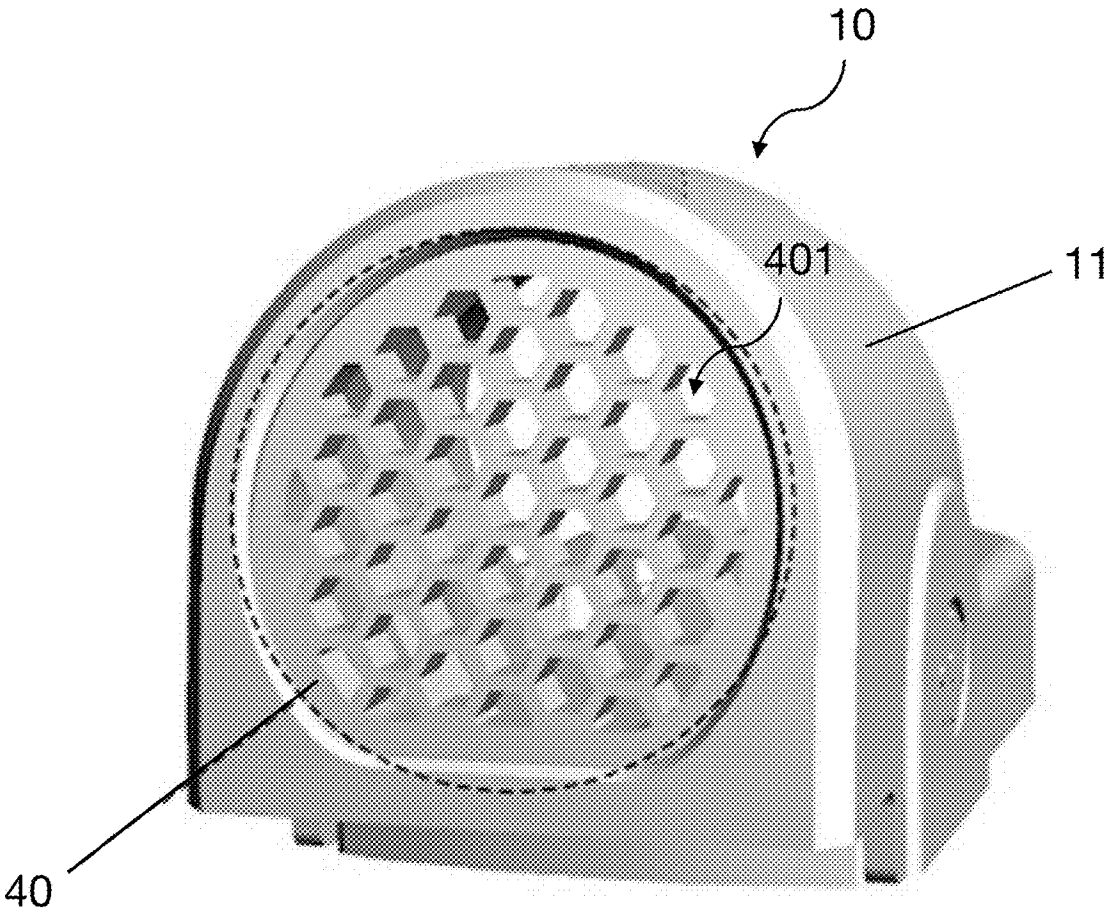
FIG. 11 is a perspective view of the protective cover showing the cover body having a lens shield with through holes according to another aspect of the embodiments.

Referring to FIG. 11, in still embodiments, the lens shield 40 may comprise a plurality of through holes 401 configured to allow the user to aim the target, and in such a manner, light reflections may be reduced by the through holes configuration of the lens shield 40. It should be noted that, in some embodiments, the through-holes configuration of the lens shield 40 may reduce the interference generated by the UV lights and also allow the user to aim at the targets.

In still some embodiments, the lens shield 40 may be attached to the inner surface of the cover body 11 to cover the vision opening of the cover body.

Figure 12:
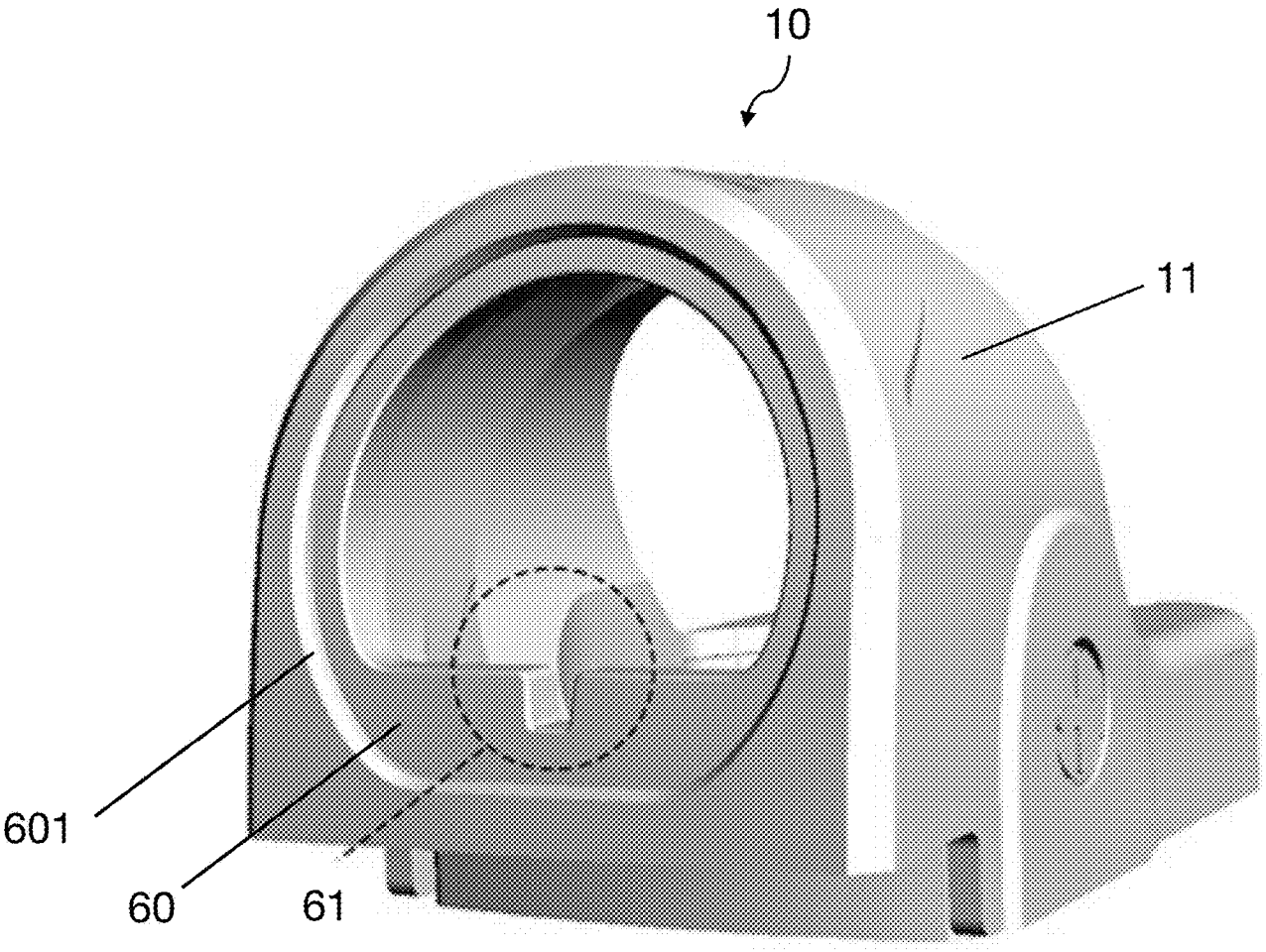
FIG. 12 is a perspective view of the protective cover showing the cover body having an aiming plate according to an aspect of the embodiments.

Referring to FIG. 12, the protective cover 10 may further an aiming plate 60 cooperated with the cover body 11, wherein the aiming plate 60 may have an aiming slot 61 configured to allow the user to aim the target.

In some embodiments, the aiming plate 60 may be arranged along an edge 601 defined by the vision opening 12 (also see FIG. 3A), wherein the edge 601 may be defined as a peripheral edge of the vision opening 12. In still some embodiments, the aiming plate 60 may be contacted with the inner surface 18 of the cover body 11.

Figure 13:
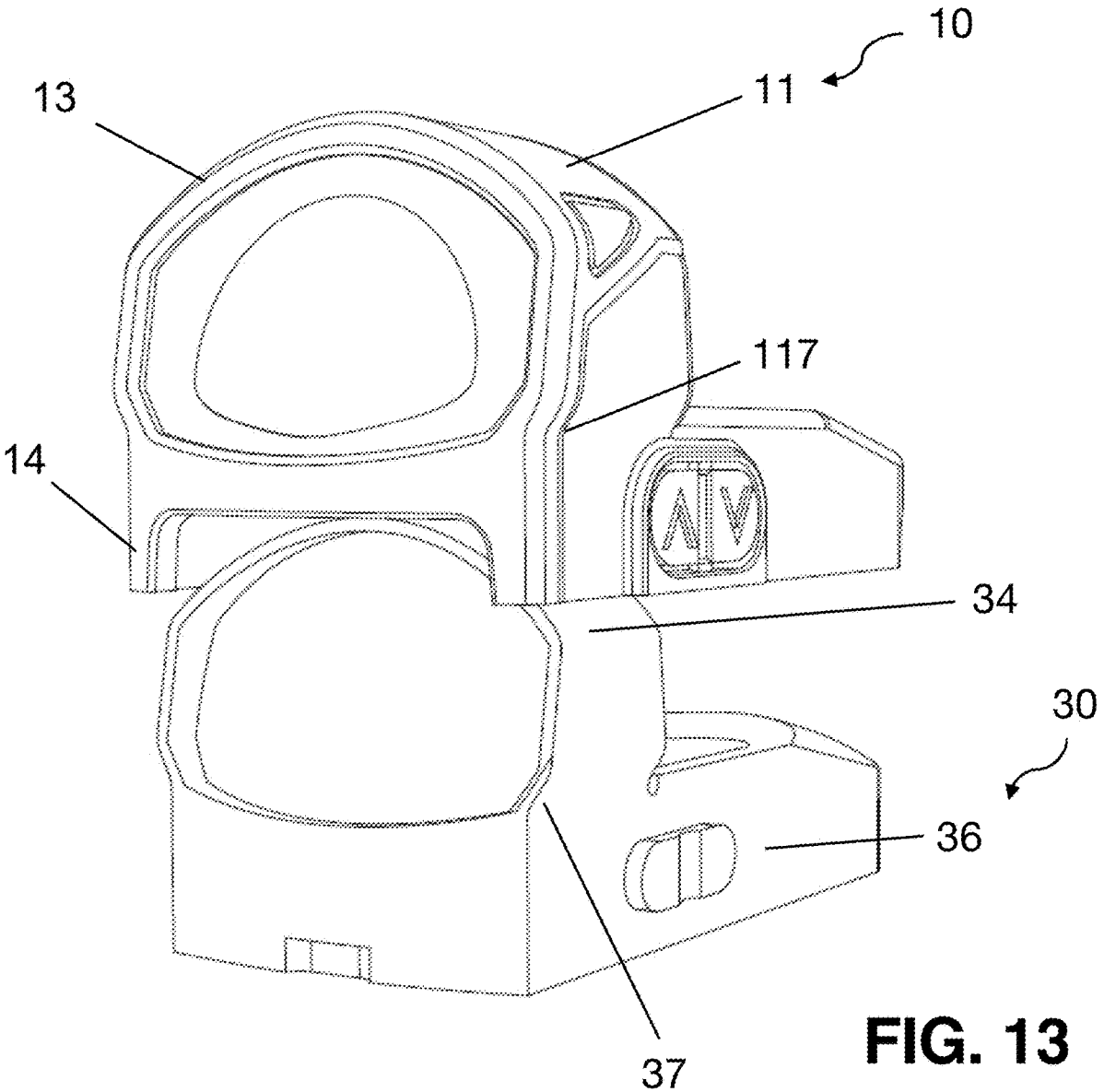
FIG. 13 is a perspective view showing the protective cover being covered on the sighting device according to still another aspect of the embodiments.

Referring to FIG. 13, in some embodiments, the cover body 11 may comprise a housing portion 13, a base portion 14, and a concave edge 117 formed between the housing portion 13 and the base portion 14.

In still some embodiments, the sighting device 30 may comprise the top sight portion 34, a bottom sight portion 36 integrally and inwardly extended from the top sight portion 34 to form a middle sight portion 37, wherein the bottom sight portion 36 may be configured to be installed on the firearm, and the middle sight portion 37 may be formed between the top sight portion 34 and the bottom sight portion 36.

Continuing to FIG. 13. in still some embodiments, the cover body 11 may further comprise a concave edge 117, wherein the base portion 14 may be outwardly extended to form the housing portion 13 and the concave edge 117 may be naturally formed between the base portion 14 and the housing portion 13.

In still some embodiments, while the cover body 11 is covered on the sighting device 30, the concave edge 117 of the cover body 11 may be locked on the middle sight portion 37 of the sighting device 30 without falling.

Figure 14:
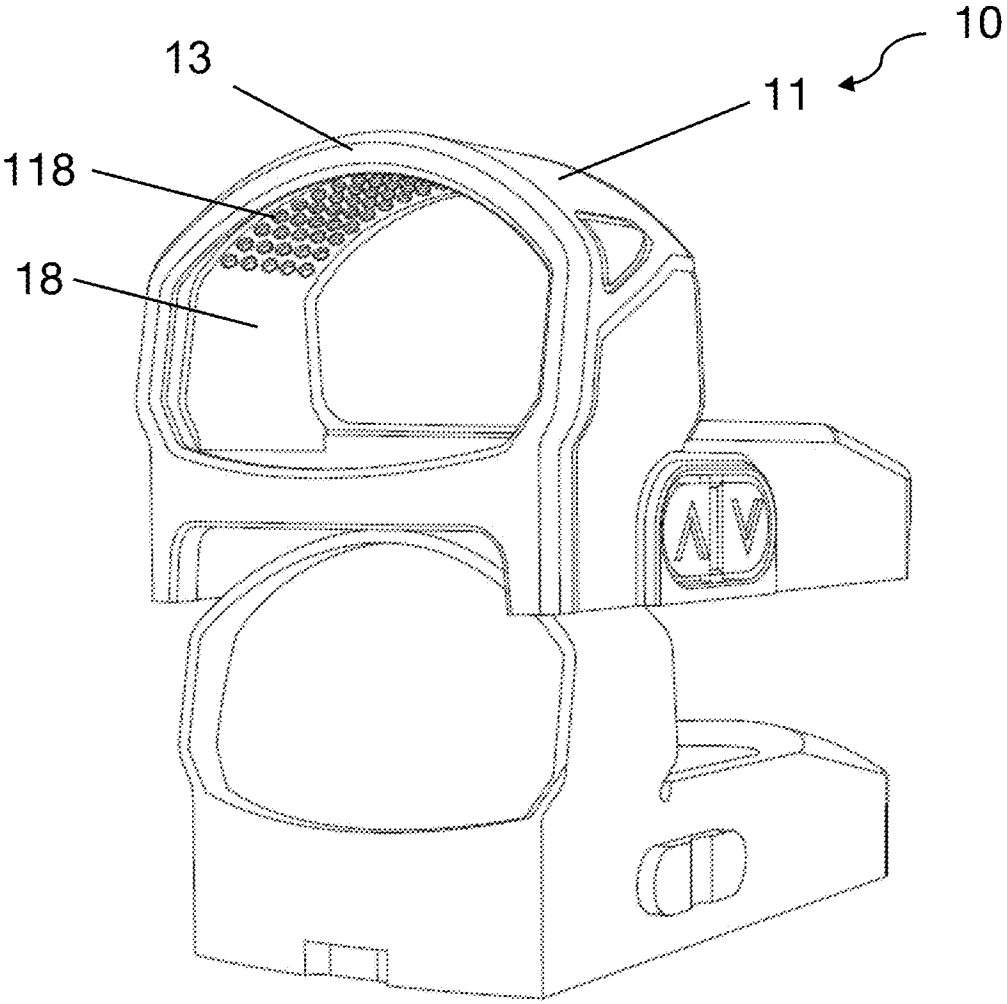
FIG. 14 is a perspective view of the protective cover showing a plurality of anti-shocking elements arranged on the cover body according to an aspect of the embodiments.

Referring to FIG. 14, in some embodiments, the cover body 11 may comprise a plurality of anti-shock elements 118 arranged on an inner surface 18 of the cover body 11. In still some embodiments, the plurality of ani-shock elements 118 may be formed on the inner surface 18 of the housing portion 13 of the cover body 11.

Figure 15:
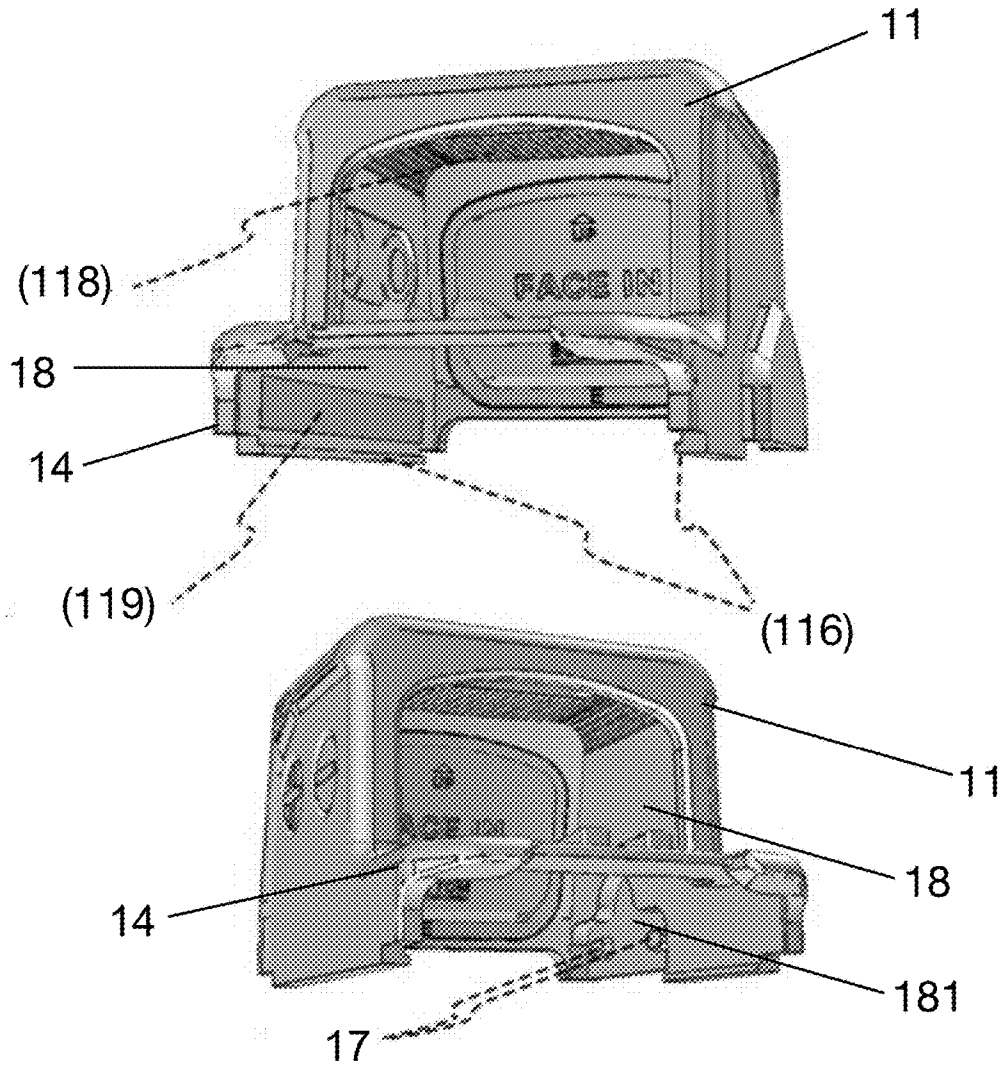
FIG. 15 is a perspective view of the protective cover showing a removable adhesive and locking units arranged on the cover body according to an aspect of the embodiments.
Figure 16:
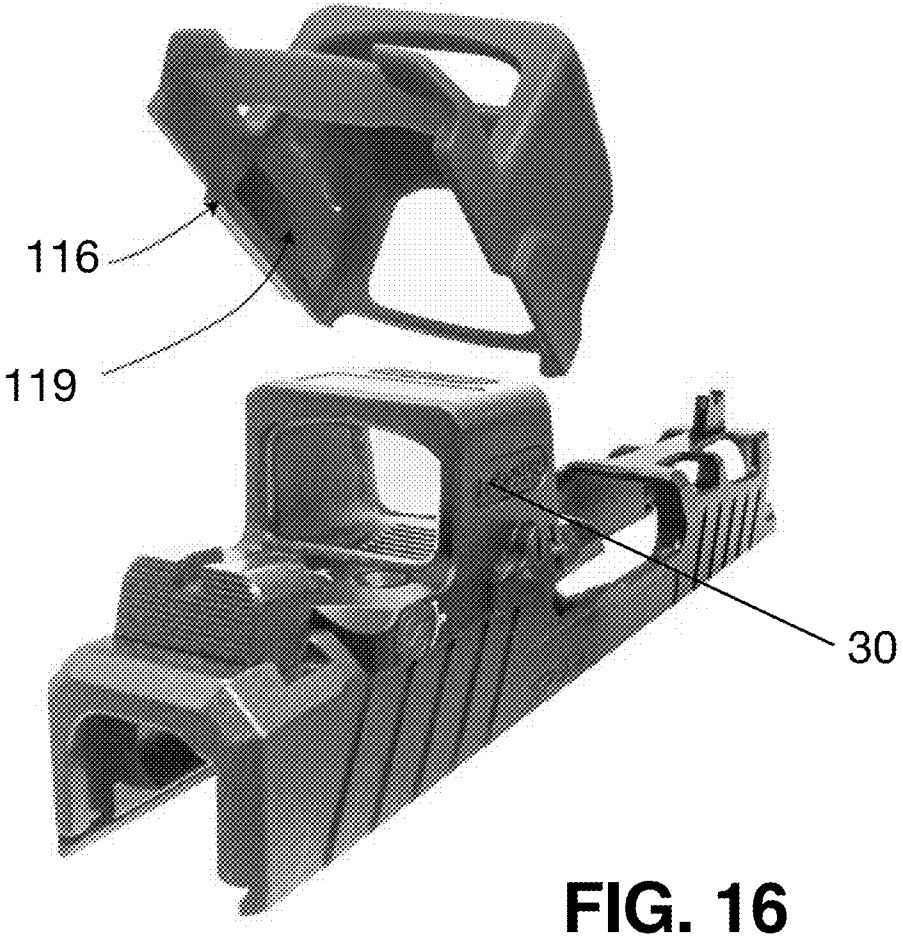
FIG. 16 is a perspective view showing the cover body attached to the sighting device according to an aspect of the embodiments.

Referring to FIGS. 15-16, in some embodiments, the cover body 11 may comprise the bottom securing unit 116 inwardly extended from the base portion 14 of the cover body 11. In still some embodiments, while the cover body 11 is covered on the sighting device 30, the bottom securing unit 116 may be clipped on the bottom sight portion of the sighting device 30, to secure the cover body 11 on the sighting device 30.

As shown in the details of FIGS. 15-16, in some embodiments, the cover body 11 may comprise a removable adhesive 119 arranged on side surfaces of the inner surface 18 of the cover body 11. It should be noted that, in some embodiments, the removable adhesive 119 may be arranged on the inner surface 18 of the base portion 14 of the cover body 11.

Figure 17:
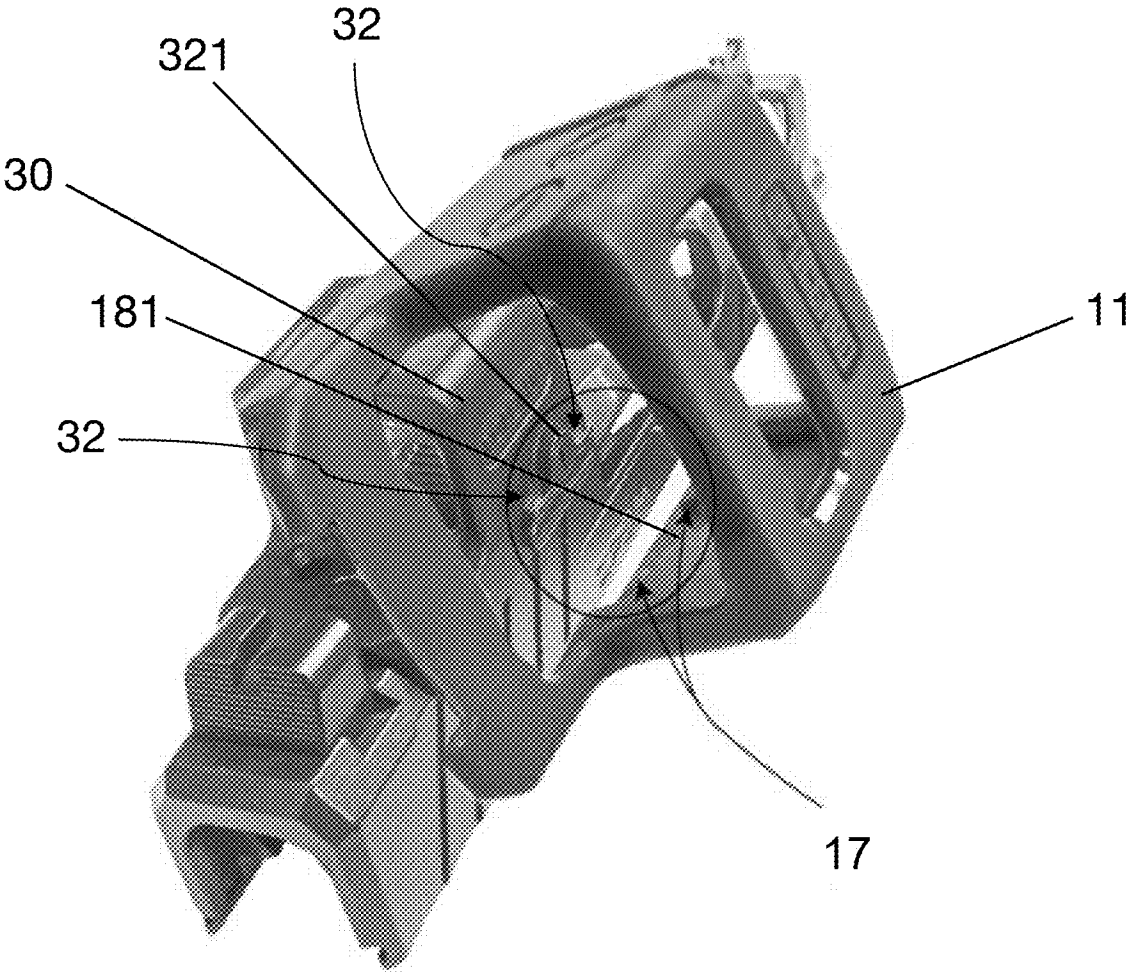
FIG. 17 is a perspective view showing the locking units engaged with the concave slot according to an aspect of the embodiments.

Referring to FIG. 15 and FIG. 17, in some embodiments, the cover body 11 may comprise a recess surface 181 concavely formed on the inner surface 18 of the base portion 14 of the cover body 11. In still some embodiments, the cover body 11 may comprise at least one locking unit 17 formed on the recess surface 181, and in other words, the locking unit 17 may be formed on the inner surface 18 of the base portion 14 of the cover body 11, wherein the locking units 17 may be upwardly protruded from the recess surface 181. It should be noted that the recess surface 181 is inwardly extended from the inner surface 18 to form a concave surface.

In still some embodiments, while the cover body 11 is covered on the sighting device, the locking units 17 may be inserted into the sighting device 30 or the locking units 17 may be clipped on the sighting device 30.

In still some embodiments, while the cover body 11 is covered on the sighting device 30, the locking units 17 may be engaged with the concave slots 32 formed on the sighting device 30. For one example, the concave slots 32 may be formed on side surfaces of the sighting device 30, wherein concave slots 32 may be naturally formed above a side protrusion 321 arranged on the side surfaces of the sighting device 30, and in such a manner, the locking units 17 may be engaged with the slots 32 to secure the cover body 11 on the sighting device 30.

Figure 18:
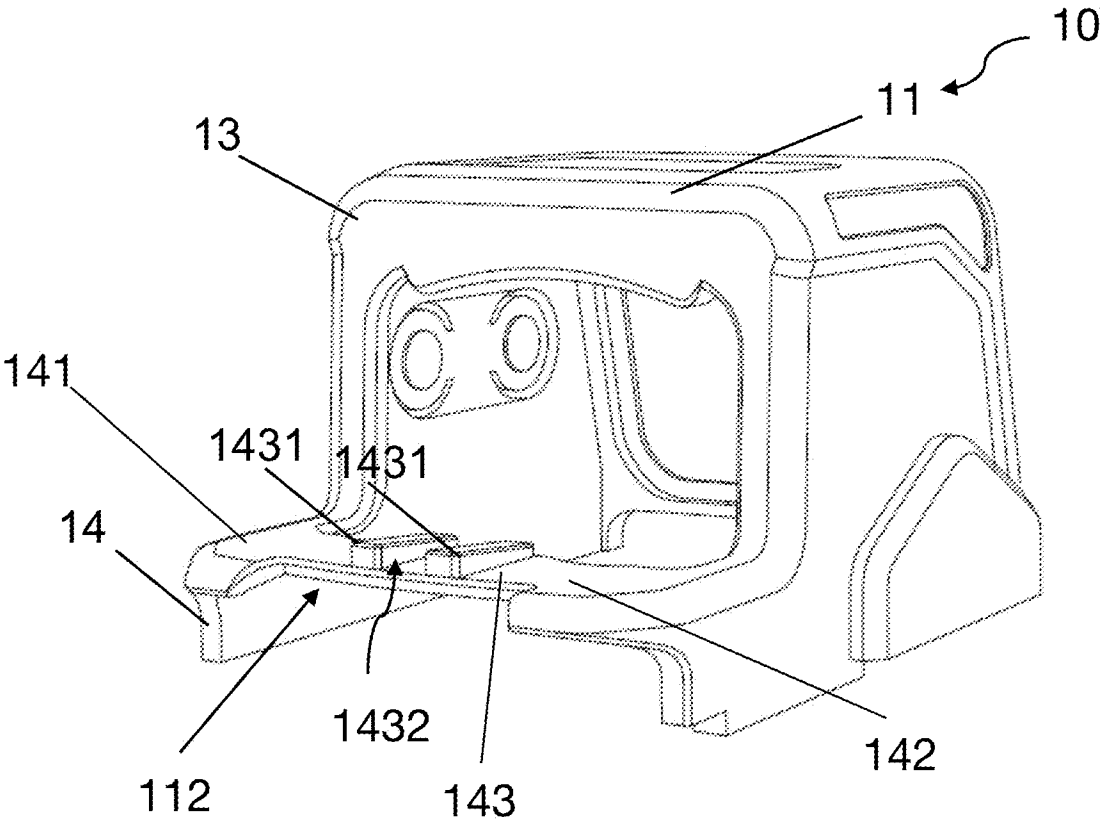
FIG. 18 is a perspective view of the protective cover showing aiming blocks arranged on the cover body according to an aspect of the embodiments.

Referring to FIG. 18, the cover body 11 may comprise at least one aiming block 1431 formed on the base portion 14 of the cover body 11. In some embodiments, each of the aiming blocks 1431 may be spacedly arranged to form an aiming slot 1432, wherein the aiming slot 1432 may facilitate the user for aiming the targets.

In some embodiments, the aiming blocks 1431 may be formed on the middle supporting frame 143, wherein the aiming blocks may be formed between the right base portion 142 and the left base portion 141.

Figure 19:
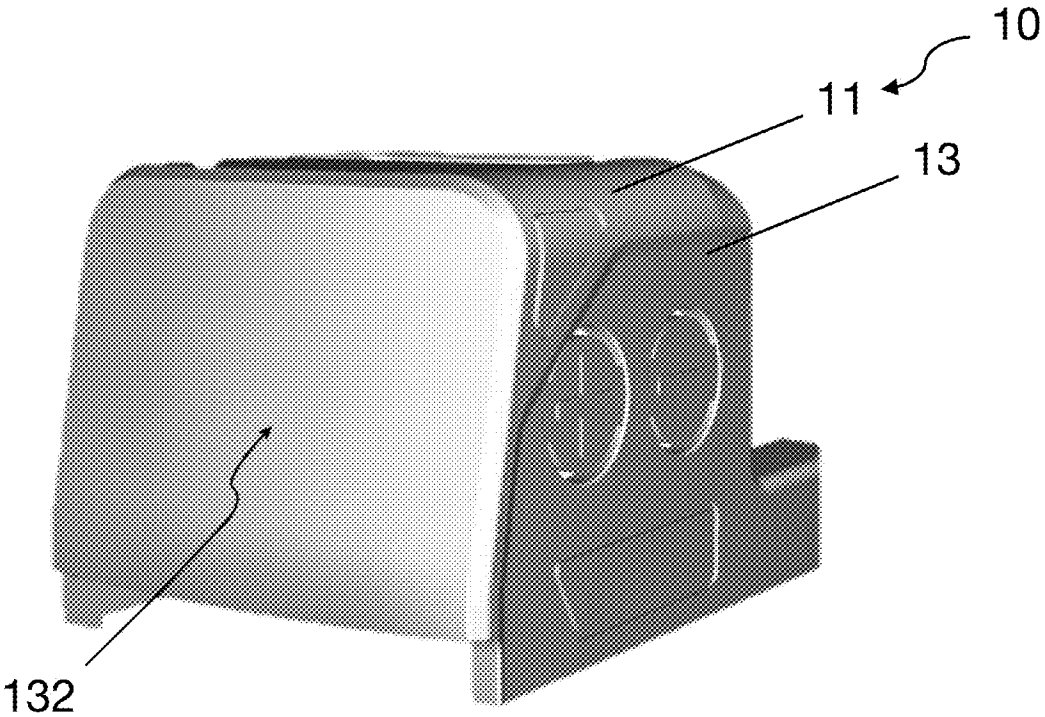
FIG. 19 is a perspective view of a one-piece cover body according to an aspect of the embodiments.

Referring to FIG. 19, the cover body 11 may comprise the housing portion 13, and a front portion 132 integrally extended from the housing portion 13 to form a one-piece configuration.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the protective cover for sighting devices have been disclosed. It should be apparent, however, to those skilled in the art that many more modifications besides those already described are possible without departing from the disclosed concepts herein. The disclosed embodiments, therefore, are not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structures, material or acts for performing substantially the same function in the same way to obtain the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A protective cover for a sighting device installed on a firearm, comprising:

a cover body having an inner surface of the cover body and is configured to be engaged with the sighting device and having a rear vision opening;

the sighting device having a top protrusion;

wherein the cover body comprises a top securing unit which is configured to be clipped on the top protrusion to tightly secure the cover body on the sighting device; wherein the cover body comprises a housing portion, a base portion integrally and outwardly extended to form the housing portion, and a concave edge naturally and integrally formed between the housing portion and the base portion; wherein the cover body comprises a recess surface concavely formed on the inner surface of a base portion of the cover body and at least one locking unit upwardly and integrally protruding from the recess surface.

2. The protective cover of claim 1, wherein the cover body comprises a vision opening and a lens shield being detachably covered on the vision opening, wherein the lens shield comprises an inclined surface formed adjacent to a periphery of the lens shield.

3. The protective cover of claim 1, wherein the cover body comprises a top opening formed on a top side of a housing portion of the cover body.

4. The protective cover of claim 1, wherein the sighting device comprises a top sight portion, a bottom sight portion integrally extended from the top sight portion and configured to be installed on the firearm, and a middle sight portion formed between the top sight portion and the bottom sight portion.

5. The protective cover of claim 1, wherein the cover body comprises a housing portion dimensioned to conform with the sighting device, a base portion having a right base portion and a left base portion integrally extended from the housing portion, and a middle supporting frame horizontally extended and connected between the left base portion and the right base portion to prevent deformation of the cover body.

6. The protective cover of claim 1, wherein the cover body comprises a housing portion, a base portion having a right base portion and a left base portion integrally extended from the housing portion, a middle supporting frame horizontally extended and connected between the left base portion and the right base portion, and a downward concave edge indentedly formed on the middle supporting frame for facilitating aiming.

7. The protective cover of claim 1, wherein the top protrusion is outwardly extended from a top sight portion of the sighting device.

8. The protective cover of claim 1, wherein the lens shield comprises a plurality of through holes for aiming.

9. The protective cover of claim 1, further comprising an aiming plate contacting with an inner surface of the cover body and configured to cover with a vision opening of the cover body, wherein the aiming plate has an aiming slot.

10. The protective cover of claim 1, wherein the top securing unit is inwardly extended from an edge defined by a vision opening of the cover body to form a receiving cavity, wherein the top protrusion of the sighting device is engaged within the receiving cavity.

11. The protective cover of claim 1, wherein the cover body comprises a housing portion, a base portion, and a bottom securing unit inwardly extended from the base portion, wherein the bottom securing unit is clipped on a bottom sight portion of the sighting device.

12. The protective cover of claim 1, wherein the cover body comprises a concave edge and the sighting device comprises a middle sight portion, wherein the concave edge is locked on the middle sight portion to keep the cover body on the sighting device.

13. The protective cover of claim 1, wherein the cover body comprises a plurality of anti-shock elements arranged on an inner surface of a housing portion of the cover body.

14. The protective cover of claim 1, wherein the cover body comprises a removable adhesive arranged on an inner surface of a base portion of the cover body.

15. The protective cover of claim 1, wherein the cover body comprises at least one aiming block formed on a base portion of the cover body.

16. The protective cover of claim 1, wherein the cover body comprises at least one aiming block formed on a middle supporting frame of a base portion, wherein each of the aiming blocks is spacedly arranged to form an aiming slot for aiming.

17. The protective cover of claim 1, wherein the cover body comprises a housing portion, and a front portion integrally extended from the housing portion to form a one-piece configuration.

* * * * *